US005145395A

United States Patent [19]

Kuei Lai

[11] Patent Number: 5,145,395

[45] Date of Patent: Sep. 8, 1992

[54] ELECTRICAL CONNECTOR EMBEDDED WITH PLASTIC LATCHES

[76] Inventor: Lee C. Kuei Lai, c/o Hung Hsing Patent Service Center, P.O. Box 55-1670, Taipei, Taiwan

[21] Appl. No.: 753,938

[22] Filed: Sep. 3, 1991

[51] Int. Cl.[5] ..... H01R 13/00

[52] U.S. Cl. ..... 439/326; 439/353

[58] Field of Search ..... 439/326-328, 439/329, 353, 354

[56] References Cited

U.S. PATENT DOCUMENTS 3,848,952 11/1974 Tighe, Jr. ..... 439/326

4,713,013 12/1987 Regnier et al. ..... 439/326

*Primary Examiner*—Joseph H. McGlynn

[57] ABSTRACT

An electrical connector includes at least a pair of plastic latches embedded in two opposite end portions of the connector, each latch made of resilient plastic material having a peg member protruding downwardly from the latch through a latch holding base formed on each end portion of the connector and through a mother board for combinably securing each latch with the connector and the mother board for electrically connecting a daughter board inserted in the connector with the mother board connected under the connector.

11 Claims, 2 Drawing Sheets

ELECTRICAL CONNECTOR EMBEDDED WITH PLASTIC LATCHES

BACKGROUND OF THE INVENTION

Recent developments of electrical connectors for use in connecting a daughter printed circuit board with a mother printed circuit board are aimed to disclose metal latches to substitute those connectors each connector integrally formed with latch members on a connector base to prolong the service life of the latches and connector, from which a damaged latch can be replaceable with a new one, rather than discarding a complete set of electrical connector for saving cost.

Korsunsky et al. disclosed an electronic module socket with resilient latch in their U.S. Pat. No. 4,995,925. However, each U-shaped latch (100) of metal should be made to have an engaging configuration insertable in a pocket (40), still causing a production complexity of the connector. Yagi et al. invented a metal latch for SIMM socket in the U.S. Pat. No. 5,004,429 which requires a housing engaging portion (58) formed on the latch to be engageable with a socket housing (12), thereby being unable to reduce a production cost of the connector.

Regarding the Korsunsky's connector (socket 20), two pegs are protruded downwardly from the bottom portion of the connector made of material durable for high temperature for fixing the connector on a mother board, and are easily vulnerably broken when the connector is merely made of plastic materials of temperataure resistance without considering its elasticity and is subjected to an oven of high temperature for soldering the terminal leads 26 on a bottom of the mother board. Therefore, the peg of the Korsunsky's connector and a complete set of the connector should be made of plastic material in consideration of two factors, i.e., durability for high temperature and better elasticity, thereby increasing the production cost of the whole connector.

As to the Yagi's patent, the socket adapted for receiving the Yagi's metal latch may also be subjected to high temperature soldering processing and the socket should also be made of plastic materials durable for high temperature and high elasticity to prevent a breakage of the socket when depressing the metal latch inserted in the socket. Since the whole socket unit is integrally made of plastic material in consideration of both its temperature resistance and elasticity, the cost of the socket can not be reduced accordingly.

The present inventor has found the drawbacks of a conventional connector provided with metal latch, and invented the present connector embedded with plastic latches.

SUMMARY OF THE INVENTION

The object of the present invention is to provide an electrical connector includes at least a pair of plastic latches embedded in two opposite end portions of the connector, each latch made of resilient plastic material having a peg member protruding downwardly from the latch through a latch holding base formed on each end portion of the connector and through a mother board for combinably securing each latch with the connector and the mother board for electrically connecting a daughter board inserted in the connector with the mother board connected under the connector.

DETAILED DESCRIPTION

Figure 1:
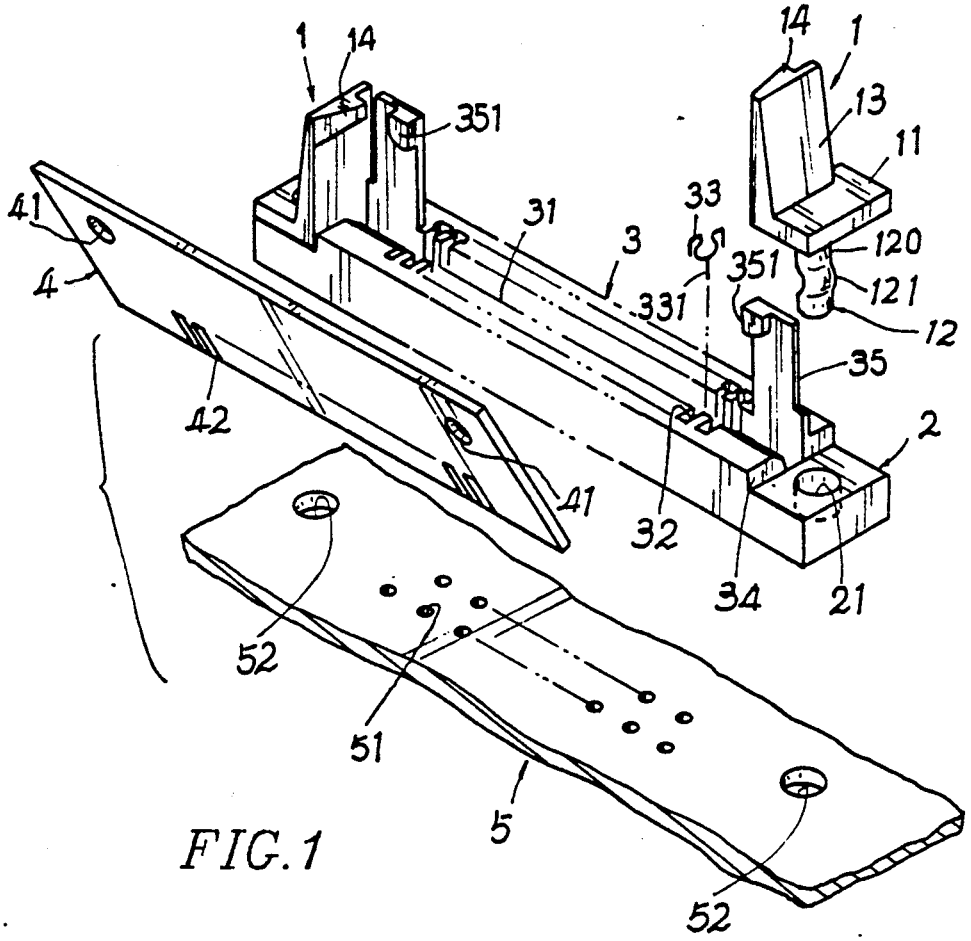
FIG. 1 is a perspective view of the present invention.
Figure 2:
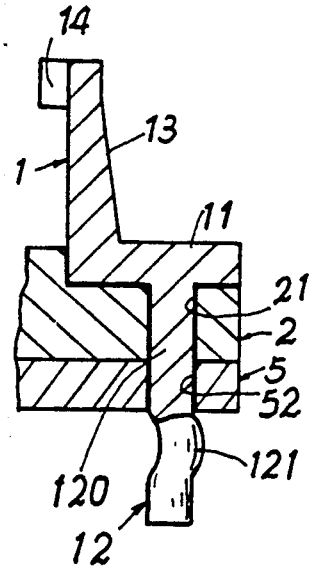
FIG. 2 is a partial sectional drawing of the present invention.

As shown in FIGS. 1 and 2, the present invention comprises: an electrical connector 3 having a pair of plastic latches 1 embedded in two latch holding bases 2 respectively formed on two opposite end portions of the connector 3 for electrically connecting a daughter printed circuit board 4 inserted in the connector 3 with a mother printed circuit board 5 connected under the electrical connector 3.

The electrical connector 3 includes: a longitudinal socket 31 longitudinally formed in the connector 3, a plurality of slots 32 transversely formed in the connector 3 each slot 32 generally perpendicular to the longitudinal socket 31 for embedding a spring contact element 33 having a supporting leg member 331 protruding downwardly from the connector 3 to be inserted into a leg hole 51 formed in the mother board 5, two vertical side wall portions 34 formed on two opposite end portions of the connector 3 each side wall portion 34 perpendicular to the socket 31, and two stop members 35 formed on two opposite end portions of the connector 3 each stop member 35 adjacent to each side wall portion 34 and generally parallel to the longitudinal socket 31. Each stop member 35 is formed with an alignment protrusion 351 on its top portion.

Each latch holding base 2 is formed on each end portion of the connector 3 recessed from each vertical side wall portion 34, and is formed with a connector peg hole 21 through the base 2. The mother board 5 is formed with two board peg holes 52 in two opposite end portions of the board 5 each board peg hole 52 projectively corresponding to each the connector peg hole 21 formed in the latch holding base 2 formed on the connector 3.

Each plastic latch 1 includes: a base plate 11 generally formed with a horizontal platform plate engageable with each latch holding base 2 formed on the connector 3, a peg member 12 protruding downwardly from the base plate 11 insertably passing through a connector peg hole 21 formed in the latch holding base through a connector peg hole 21 formed in the latch holding base 2 of the connector 3 and through a board peg hole 52 formed in the mother board for combinably securing the latch 1 with the connector 3 and the mother board 5, a vertical latch member 13 protruding upwardly from the base plate 11 to be perpendicular to the longitudinal socket 31 of the connector 3, and a latching wedge portion 14 formed on an upper portion of the latch 1 tapered rearwardly and inwardly for slidably guiding a daughter board 4 to be resiliently clamped by two latches 1 and stopped by two stop members 35 respectively formed on two opposite end portions of the connector 3.

The peg member 12 of each latch 1 is formed with a barb portion 121 on a lower portion of the peg member 12 adjacent to a shank portion 120 of the peg member 12. The shank portion 120 of the peg member 12 as shown in FIG. 2 has a length generally equal to a total thickness of a thickness of the latch holding base 2 of the connector 3 plus a thickness of the mother board 5, thereby firmly locking the board 5 and the connector 3 with the latch 1 as limited by the barb portion 121.

The latch 1 is made of resilient plastic materials selected from: nylon, polyurethane, polycarbonate, polyethylene, polyacetal, PBT, etc., not limited in this invention.

The daughter board 4 is formed with two openings 41 on two opposite sides of the board 4 respectively engageable with two protrusions 351 of the two stop members 35 formed on the connector 3 and an electrical conducting area 42 on a lower portion of the board 4. The board 4 is inserted into the longitudinal socket 31 of the connector 3 to be clamped by the plurality of spring contact elements 33 embedded in the connector 3 as slidably guided by the two wedge portions 14 of the two latches 1 secured on the connector 3. After engaging each alignment protrusion 351 of each stop member 35 with each opening 41 of the daughter board and clamping the daughter board 4 by the two latches 1 disposed on two opposite ends of the connector 3, the daughter board 4 is firmly connected on the connector 3 and the conducting area 42 formed on the lower portion of the daughter board 4 is electrically connected with the plural contact elements 33 and finally connected with the mother board 5 secured under the connector 3 for finishing the electrical connection between the two boards 4, 5.

The present invention is superior to a conventional electrical connector provided with metal latches with the following advantages:

1. Just by engaging the peg member 12 of each latch 1 with the peg holes 21, 52 formed in the connector base 2 and in the mother board 5, the latch 1 will be secured on the connector 3 also combining the mother board 5 under the connector 3 for a very easier assembly and maintenance job of the connector.

2. The structure, orientation, three-dimensional configuration and the lay-out of the the latch is simpler to reduce its production cost, also simplifying its installation and maintenance.

3. Each latch is integrally formed by plastic injection molding process, thereby saving any processing job, such as for saving the formation of a resilient bight portion or a housing engaging arm portion of a conventional metal latch.

4. Even the latch 1 and the peg member 12 of this invention is made of resilient and temperature-resistant material having a cost expensive than that of the connector unit 3 (of which the connector 3 may be made of material only in consideration of the temperature-resistance factor, rather than the elasticity factor, for a cheaper cost of the connector), a volume and weight of the latch is relatively smaller in comparison with that of the whole connector 3, so that the production cost of the present invention is cheaper and more economic than the Yagi and Korsunsky prior arts.

Figure 3:
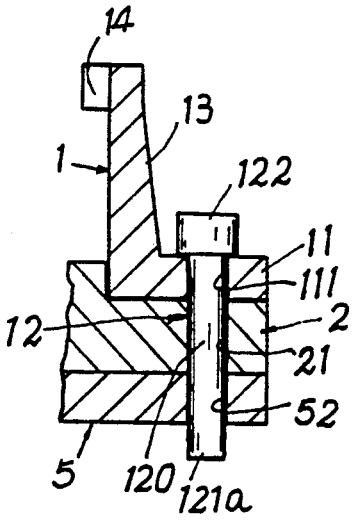
FIG. 3 is a partial sectional drawing of another preferred embodiment of the present invention.

Concerning the cost factor of this invention especially in view of FIG. 3, the plastic latch 1 as already separated from the peg member 12 may only take the elasticity factor into account without considering the factor of temperature resistance so as to greatly reduce the total cost of the connector, which is especially more economic and improved over the prior arts as aforementioned.

5. A barb portion 121 is formed on a lower portion of the peg member 12 for firmly securing the latch 1 with the connector 2 and the board 5, thereby serving as an enhanced locking mechanism for a stable combination of the several elements in construction of this invention when subjected to a soldering processing or other assembly works, to be therefore superior to the Korsunsky's prior art since each Korsunsky's peg is made of smooth round bar which is inserted through the peg holes formed in the socket 20 and a mother board (not shown) to be easily loosened during the soldering processing, causing an unbalanced mounting of the connector on the mother board and effecting a poor product quality.

The peg member 12 may also be separated and individually made as shown in FIG. 3, in which the base plate 11 of the plastic latch 1 is formed with a plate peg hole 111 therin, and the peg member 12 may be formed to have a shank portion 120 having a diameter slightly larger than an inside diameter of the peg hole 21 formed in the base 2 or the hole 52 formed in the mother board 5 for a firm insertion of the peg member 12 through the holes 111, 21, 52 of the latch 1, the connector base 2, and the board 5 to protrude a peg tip 121*a* beyond a bottom of the mother board 5; and a head portion 122 formed on a top portion of the peg member 12 for retaining the peg member 12 on the base plate 11 of the latch 1. Due to frictional holing between two plastic elements, the peg member 12 may be formed as a single bolt without forming the head portion 122. The peg member 12 may be made of plastic material or metal material.

Figure 4:
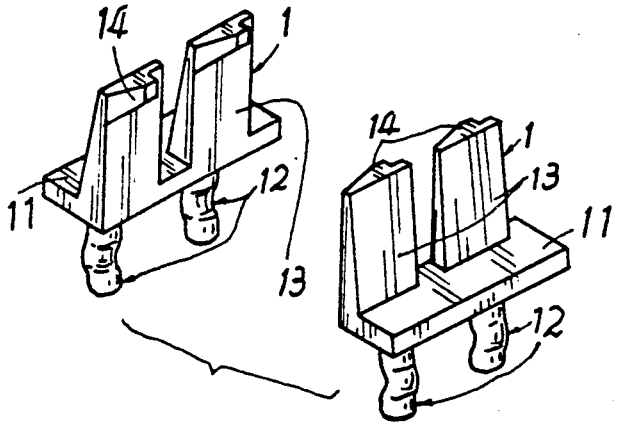
FIG. 4 shows still another preferred embodiment of the present invention.

As shown in FIG. 4, each base plate 11 of the latch 1 may include a plurality of vertical latch members 13 juxtapositionally formed thereon and a plurality of peg members 12 juxtapositionally formed thereunder.

The present invention may be modified to be used for those connectors having inclined shapes for a tilting positioning of a daughter board on the connector (not shown).

Figure 6:
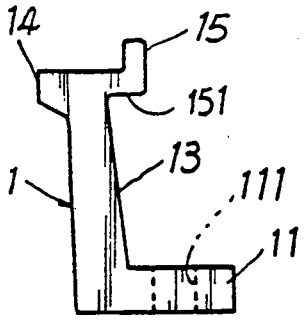
FIGS. 5 and 6 show further preferred embodiments of the plastic latch of the present invention.
Figure 5:
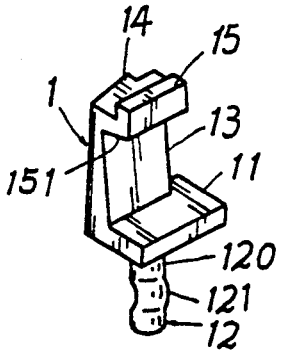

As shown in FIGS. 5 and 6, a depression extension 15 is protruded upwardly from an upper platform 151 extending laterally outwardly from the wedge portion 14 of the latch 1 adapted for depressing a daughter board 4 when clamped by the two latches 1.

I claim:

1. An electrical connector comprising:

a longitudinal socket longitudinally formed in the connector for inserting a daughter printed circuit board therein, a plurality of slots transversely formed in the connector each said slot generally perpendicular to the longitudinal socket for embedding a spring contact element having a supporting leg member protruding downwardly from the connector to be inserted into a leg hole formed in a mother board, and two stop members formed on two opposite end portions of the connector each stop member generally parallel to the longitudinal socket, and formed with an alignment protrusion on a top portion of each stop member;

said connector recessed from a vertical side wall portion formed on each end portion of said connector to form a latch holding base having a connector peg hole formed through the latch holding base;

at least two plastic latches made of resilient plastic material each said plastic latch embedded on each said latch holding base of said connector, each said plastic latch having a peg member formed under said latch insertable through the connector peg hole of said connector and through a board peg hole formed in one end portion of a mother printed circuit board projectively corresponding to said connector peg hole for combinably securing each said latch with said connector and said mother board for an electrical connection between said daughter and mother boards.

2. An electrical connector according to claim 1, wherein said peg member of said latch is operatively insertable in a plate peg hole formed in a base plate of said latch, the said peg member having a shank portion with a diameter slightly larger than an inside diameter of the peg hole formed in the latch holding base and the board peg hole formed in the mother board for a firm insertion of the peg member through the said peg holes formed in said latch, said base of said connector, and said mother board to protrude a peg tip beyond a bottom of the mother board; and a head portion formed on a top portion of the peg member for retaining the peg member on the base plate of the latch.

3. An electrical connector according to claim 1, wherein each said plastic latch includes a base plate having a plurality of vertical latch members juxtapositionally protruding upwardly from said base plate, and a plurality of peg members juxtapositionally protruding downwardly from said base plate.

4. An electrical connector according to claim 1, wherein said plastic latch is formed with a depression extension protruded upwardly from an upper portion of said latch adapted for depressing said latch for releasing a daughter board clamped by two said latches embedded on said connector.

5. An electrical connector according to claim 1, wherein each said plastic latch includes: a base plate generally formed with a horizontal platform plate engageable with each latch holding base formed on the connector, the peg member protruding downwardly from the base plate insertably passing through the connector peg hole formed in the latch holding base of the connector and through a board peg hole formed in the mother board for combinably securing the latch with the connector and the mother board, a vertical latch member protruding upwardly from the base plate to be perpendicular to the longitudinal socket of the connector, and a latching wedge portion formed on an upper portion of said latch tapered rearwardly and inwardly for slidably guiding the daughter board to be resiliently clamped by two said plastic latches and stopped by two said stop members respectively formed on two opposite end portions of the connector.

6. An electrical connector according to claim 5, wherein each said peg member of said latch is formed with a barb portion on a lower portion of the peg member adjacent to a shank portion of the peg member, said shank portion of the peg member having a length generally equal to a total thickness of a thickness of the latch holding base of the connector plus a thickness of the mother board, thereby firmly locking the board and the connector with the latch as limited by the barb portion when inserting said peg member through said connector and said mother board.

7. A plastic latch for use in an electrical connector being made of resilient plastic material and comprising:

a base plate formed on a latch holding base formed on an end portion of an electrical for inserting a daughter board in said connector, a peg member protruding downwardly from said base plate engageable with a connector peg hole formed through said holding base of said connector, and with a board peg hole formed in a mother board positioned under said connector; and a vertical latch member protruding upwardly from said base plate for clamping a daughter board in cooperation with the other latch member formed on the other plastic latch formed on an opposite end portion of said connector;

said peg member inserting through said peg holes formed in said connector and said mother board for combinably securing said plastic latch with said connector and said mother board for an electrical connection between said daughter and mother boards connected by said connector.

8. A plastic latch according to claim 7, wherein said peg member of said latch includes a barb portion formed on a lower portion of said peg member retaining a bottom of said mother board when inserting said peg member through said connector and said mother board.

9. A plastic latch according to claim 7, wherein a depression extension is protruded upwardly from an upper platform formed on an upper portion of said latch adapted for depressing said latch for releasing a daughter board clamped by two said latches embedded on said connector.

10. A plastic latch for use in an electrically connector being made of resilient plastic material and comprising:

a base plate formed on a latch holding base formed on an end portion of an electrical connector for inserting a daughter board in said connector, a peg member made pf materials selected from plastic and metal material insertable through a first peg hole formed through said base plate, and through a second peg hole formed through said holding base of said connector, and through a third peg hole formed in a mother board positioned under said connector; and a vertical latch member protruding upwardly from said base plate for clamping a daughter board in cooperation with the other latch member formed on the other plastic latch formed on an opposite end portion of said connector;

said peg member inserting through said peg holes formed in said latch, said connector, and said mother board for combinably securing said latch with said connector and said mother board.

11. A plastic latch according to claim 10, wherein a depression extension is protruded upwardly from an upper platform portion formed on an upper portion of said latch adaoted for depressing said latch for releasing a daughter board clamped by two said latches embedded on said connector.

* * * * *